US006379462B1

(12) United States Patent
Wohlfeil et al.

(10) Patent No.: US 6,379,462 B1
(45) Date of Patent: Apr. 30, 2002

(54) METERING SYSTEM FOR AN APPARATUS FOR COATING WEBS OF MATERIAL SUCH AS PAPER, PAPERBOARD OR CARDBOARD WEBS

(75) Inventors: Gerhard Wohlfeil, Monheim; Volker Fäthke, Düsseldorf, both of (DE)

(73) Assignee: Jagenberg Papiertechnik GmbH, Neuss (DE)

( * ) Notice: Subject to any disclaimer, the term of this patent is extended or adjusted under 35 U.S.C. 154(b) by 0 days.

(21) Appl. No.: 09/416,499

(22) Filed: Oct. 8, 1999

(30) Foreign Application Priority Data

Oct. 9, 1998 (DE) ..... 198 46 708

(51) Int. Cl.[7] ..... B05C 1/06
(52) U.S. Cl. ..... 118/261; 118/413
(58) Field of Search ..... 15/256.5, 256.51; 101/157, 169, 365; 162/281; 118/261, 123, 413, 126, 414, 122, 262, 419, 117, 118, 119

(56) References Cited

U.S. PATENT DOCUMENTS 4,367,691 A * 1/1983 Bergs ..... 118/119
5,738,724 A * 4/1998 Metzler ..... 118/123

FOREIGN PATENT DOCUMENTS

| | | | |
|---|---|---|---|
| DE | 30 22 955 | 12/1981 | |
| DE | 34 17 487 | 11/1985 | |
| DE | 43 41 341 | 3/1995 | |
| WO | 93/05887 | * 4/1993 | ..... 118/126 |

* cited by examiner

*Primary Examiner*—Brenda A. Lamb
(74) *Attorney, Agent, or Firm*—Herbert Dubno

(57) ABSTRACT

A metering system for the coating of webs of paper and cardboard uses a doctor bar received in an elastic bed which is urged toward the surface to be coated by a pressurizable bladder subdivided into compartments. An elastic continuous member between the diaphragm and the bed equalizes the pressure so that sudden changes in pressure in the regions between the compartments are eliminated.

12 Claims, 3 Drawing Sheets

METERING SYSTEM FOR AN APPARATUS FOR COATING WEBS OF MATERIAL SUCH AS PAPER, PAPERBOARD OR CARDBOARD WEBS

FIELD OF THE INVENTION

Our present invention relates to a metering system for a coating apparatus and, more particularly, to an apparatus for coating webs of a material such as paper, or cardboard. The invention, more particularly, relates to a metering system of the type in which a doctor bar is received in an elastic bed which is pressed toward a surface to be coated, i.e. the surface of the web as it is passed along a drum or roller surface, or the surface of a transfer roller from which the coating is applied to the web, and wherein the doctor bar is pressed toward that surface by a bladder, hose or tubular element extending along the width of the web and subdivided along the web into individually pressurizable compartments.

BACKGROUND OF THE INVENTION

For the coating of paper or cardboard webs, the coating apparatus usually is provided with a coating drum or roller along which the web is guided and a doctor system for removing the material coated onto the web to the desired basis weight or thickness of that coating, or removing excess material from a transfer roller or drum which then applies the coating onto the web. The coating material in either case is applied in excess and the metering system can comprise a doctor element which wipes off the excess to the desired basis weight (coating weight per unit area of the coated surface).

The application of the flowable material and the metering, as noted, can be carried out directly on the web, preferably in a region in which the web is deflected, e.g. around a roller or drum, or on a transfer roller from which the belt is then applied to the web.

German patent document DE-A 30 22 955 describes a metering system in which the doctor element is a doctor bar held in a bed of an elastomeric material. The bed itself is held in a holder mounted on the machine frame and is pressed toward the surface to be coated by compressed air pressurization of a bladder or hose.

German patent document DE 43 41 341 C describes a metering system in which the bladder or pressurizable hose is subdivided into a plurality of individually pressurizable compartments which can be separately supplied with compressed air. In this metering system, the pressing forces generated by the compartmented bladder arrangement varies over the width of the web and the surface to be coated and creates nonuniform coatings in terms of the basis weight at various locations across the web. As a consequence, the basis width tolerance must be increased and control efforts made so that the nonuniformity does not detrimentally affect the product. In many cases it is not possible to vary the basis weight at different locations along the width to compensate for the irregularities which may arise in the earlier system. Furthermore, it is desirable to permit the basis weight to be adjusted differently at different locations, for example, to compensate for thickness variations in the paper web or to allow reduced basis weight coating at the edges of the web.

OBJECTS OF THE INVENTION

It is the principal object of the present invention to provide a dosing or metering system for a coating apparatus of the type described that permits a uniform basis weight to be applied to a web in a precise and delicate or sensitive manner.

Another object of the invention is to provide an improved coating system which is free from drawbacks of earlier systems.

SUMMARY OF THE INVENTION

These objects are attained, in accordance with the invention by providing at the back side of the doctor-bar bed, between the pressurizable bladder with its multiplicity of individually pressurizable compartments, and the bed, an elastic element which functions as a force-balancing cushion in the boundary regions between each two pressure compartments, thereby enabling the distribution of the force applied by the bladder along the bed in a more uniform manner.

More particularly, the metering system for an apparatus of the type described can comprise:

a doctor bar adapted to doctor a coating of a flowable material onto a surface and extending transversely to a path of a web to be coated and across a width thereof;

an elastic bed receiving the doctor bar and urging the doctor bar toward the surface;

a holder receiving the bed;

a pressurizable bladder braced against the bed upon pressurization with a fluid and subdivided across the width of the web and along the length of the bar into a plurality of individually pressurizable compartments, each separately supplied with compressed air; and an elastic element extending along the bar and between the bladder and a side of the bed opposite that at which the bar is provided and forming a cushion balancing force applied by the bladder along the bed.

According to a feature of the invention, the modulus of elasticity of the elastic element is variable. The elastic element can include a continuous pressurizable hose or tube extending the full web width and along the full length of the doctor bar. The continuous tube can form one piece with the bed and the bed, the pressurizable tube and the bladder subdivided into individually pressurizable compartments can be received in a common transversely shiftable holder.

The pressurizable compartments can be provided between the back wall of the holder and the rear of the tubular elastic element and, if desired, a central rib which extends parallel to the doctor bar can connect the elastic element with the bed. The continuous pressurizable tube can have a variable pressing area or surface bearing on the back side of the bed. Each of the pressurizable compartments of the bladder can have a compressed air type which is guided out of the holder. The wall thickness of the continuous tube should be greater than the wall thickness of the bladder.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
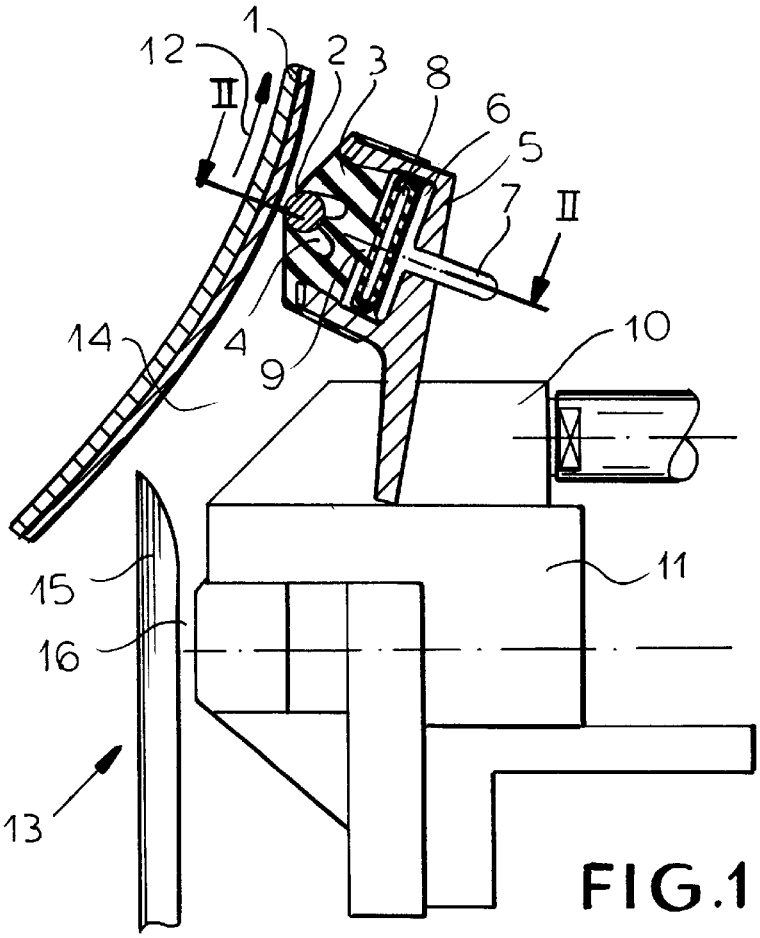
FIG. 1 is a transverse section through a metering system according to the invention.

The metering system shown in the drawing is a part of an apparatus for coating a paper or cardboard web in which a layer of a coating material is initially applied to the web on a drum or roller 1 in excess and then the excess is removed. The coating may be a viscous substance containing a pigment. A coating apparatus of this type is described, for example, in German patent document DE 30 22 955. Alternatively, the layer of the coating material can be applied directly to a transfer roller, or moved to the desired coating thickness by the metering device and applied by that roller to the web in a transfer process (see German patent document DE 34 17 487A).

In either case, the metering system can include a doctor bar 2 which is received in a bed 3 which is partly open to the surface 1 to be coated, that surface being rotated past the doctor bar by a drive not shown. The diameter of the doctor bar 2 is 8 mm to 50 mm, preferably 10 mm to 25 mm and its length corresponds to the working width of the coating apparatus, i.e. to at least the width of the widest web to be coated, up to say 10 m. The doctor bar 2 is composed of stainless steel and can have a wear-resistant coating on its surface, preferably of chromium or a ceramic. The bed 3 in which the doctor bar 2 is retained, is composed of an elastic material, preferably an elastomeric material such as a rubber, with a Shore hardness of about 80.

Passages 4 are formed in the bed 3 and into which water is fed as a lubricating and cleaning liquid during operation.

The bed 3 is movable toward and away from the surface 1 to be coated in a rigid bed holder 5, preferably formed from aluminum. The holder 5 is open toward the surface 1 to be coated, i.e. the web or the transfer roller and the end of the bed 3 with the doctor bar 2 received therein can extend through this open side of the holder. Preferably the bed 3 has, at this side, two rearwardly-directed dove-tail enlargements which prevent the penetration of the coating material into the holder. These extensions have been represented at 3*a* and 3*b* in FIG. 3.

A pressurizable bladder, hose or tube 6 is braced between a rear wall 5*a* of the holder 5 and the bed 3 and can be supplied with pressure from a compressed-air source to generate the force with which the doctor bar 2 is pressed toward the surface 1 to be coated. The bladder 6 is subdivided into individually pressurizable compartments 6.1, 6.2, 6.3, 6.4, as has been shown in FIG. 2, each of which is provided with its own compressed-air pipe 7. Each pressurizable compartment 6.1–6.4 is so supplied with compressed air that the respective region of the doctor bar 2 is applied with corresponding force toward the surface 1 to be coated.

According to the invention, between the rear side of the bed 3 and pressurizable bladder 6, an elastic element is provided which extends along the doctor bar 2 and serves as a cushion or force-distributing member which transmits pressure from the bladder 6 to the bed 3. This elastic element extends in one piece preferably over the entire working width of the coating apparatus, i.e. over the length of the bed 3 and the bar 2 in the axial direction.

Figure 3:
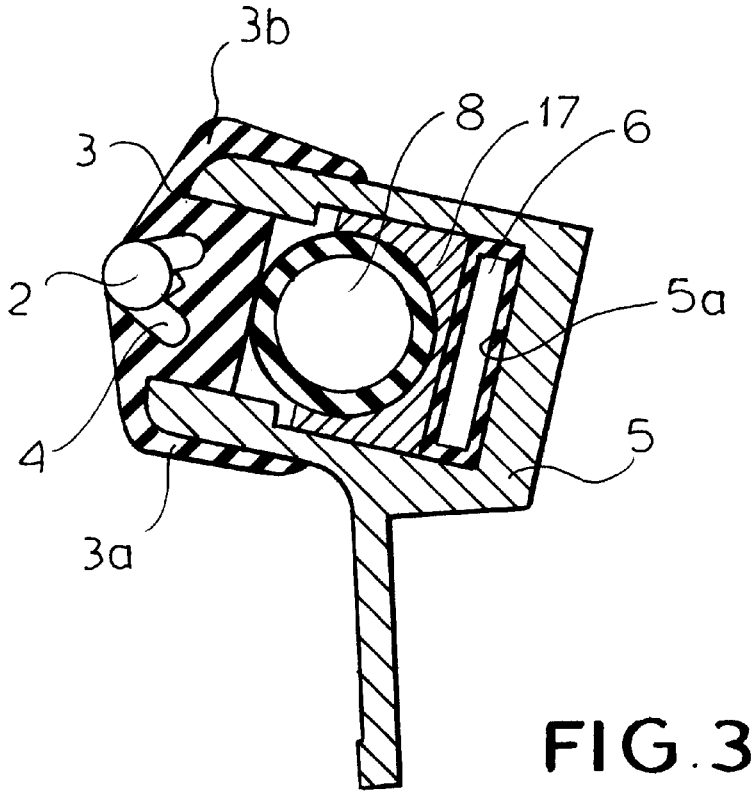
Figure 4:
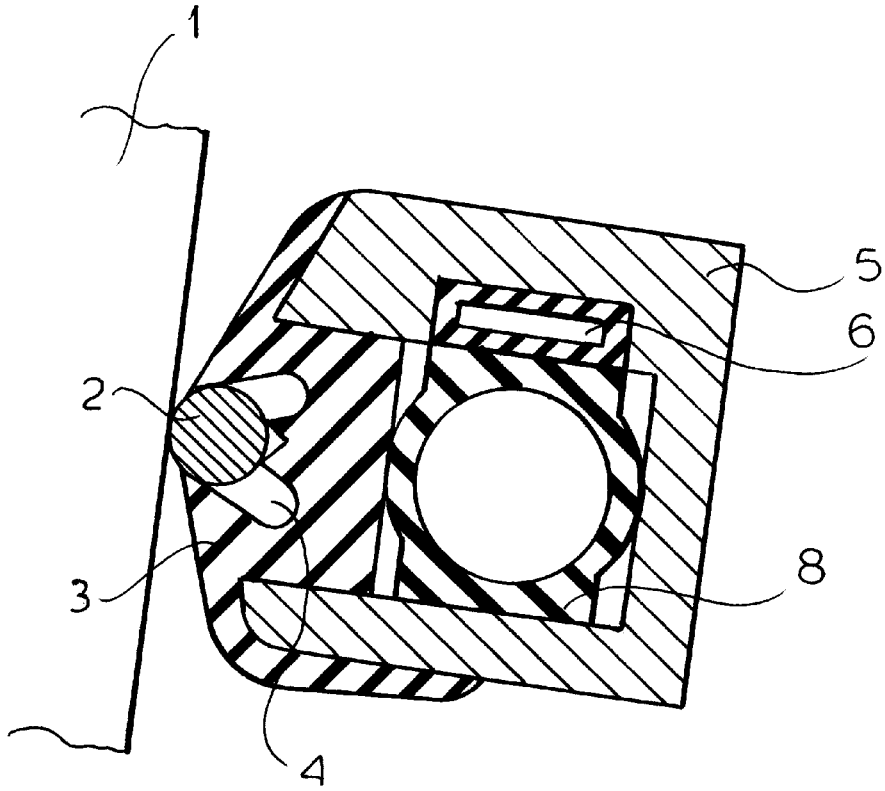

Preferably the elastic element, as shown in FIGS. 1, 3 and 4, is a continuous hose or tube 8 which can contain pressure and can be connected to its own compressed-air source so that its modulus of elasticity and cushion effect can be varied. The pressurizable tube 8 permits pressure distribution over the axial length of the bar 2 and allows, in addition, the stiffness of the overall system formed by the bar 2, the bed 3 and the tube 8 to be influenced and thus the effect on the bar 2 to be more precise or sensitively controlled than would otherwise be the case. This allows particularly sensitive control of the weight of the coating applied per unit area of the web. So that the continuous pressurizable tube 8 can transmit the locally different pressures from the bladder 6 to the rear side of the bed 3, it has a wall thickness which is sufficiently thick. Preferably the wall thickness of the tube 8, which is composed of rubber or an elastomeric material, is equal to or greater than 3 mm. The wall thickness of the pressurizable tube 6 which is subdivided into the pressure compartments is less than that of the tube 8. The bladder 6 can also be composed of an elastomeric material and is a thin wall structure so that it provides no or little hysteresis effect and can be fabricated without significant wall thickness variations.

The wall thickness of the bladder 6 is preferably substantially less than 3 mm and its height parallel to a tangent to the surface 1 to be coated can amount to 20 mm to 50 mm. Preferably the bladder 6 is formed from sections of flattened hose or tubing with a width radially of the surface 1 which is less than its height.

Figure 5:
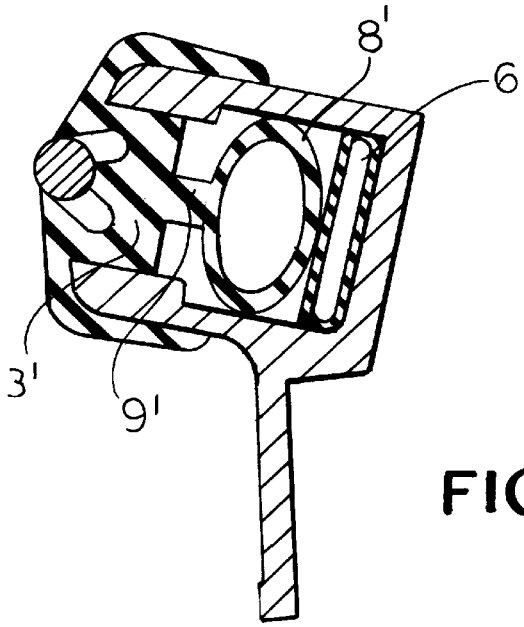
FIGS. 3, 4 and 5 are cross sectional views through different embodiments of the metering system.
Figure 2:
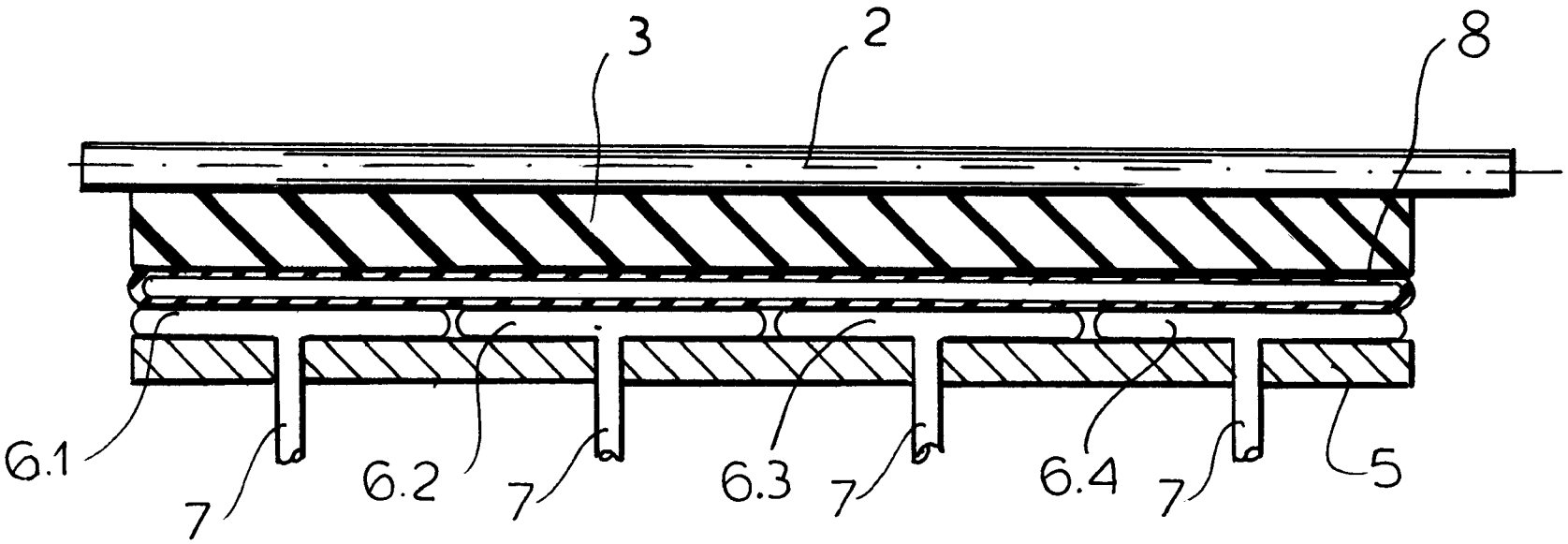
FIG. 2 is a section taken along the line II—II of FIG. 2.

In the embodiment of FIGS. 1 and 2, the continuous pressurizable tube 8 is also formed as a flattened tube or hose and it is preferably in contact with a central rib 9 running parallel to the doctor bar 2 and connected with the remainder of the bed 3. As can be seen from FIG. 5, the bed 3', the rib 9' and the continuous tube 8' can be formed in one piece, e.g. by extrusion.

In the embodiments of FIGS. 1–3, the bladder 6, received between the rear wall 5*a* of the holder 5 and the back of the bed 3. Alternatively, the bladder 6 can be received in a side wall of the holder 5 (FIG. 4) and can press against the tube 8 from the side. It is also possible to provide the bed 3, the tube 8 and/or the bladder 6 each with a respective holder which can then be provided in tandem and can be shiftable toward the surface 1 to be coated.

The bed 3 is mounted in the holder 5 so that it can move toward and away from the surface 1 to be coated with a minimum of friction. The holder 5, in turn, is clamped rigidly in the beam 10 which is mounted on a support beam 11 adjustable in the direction of the surface 1 to be coated so that a predetermined gap width between the surface 1 and the bar 2 can be maintained. The compressed-air tubes for the compartments 6.1–6.4 are led outwardly through bores in the holder 5 and can be connected via respective control valves to a compressed-air source so that individual and different pressures can be generated in the respective compartments 6.1–6.4.

In the rotary direction of the surface 1 to be coated (arrow 12) upstream of the metering system, an applicator system 13 of conventional design can be provided to apply the excess of the coating material to the surface. This applicator system can include a nozzle or roller applicator with a blade 15 forming an overflow for the compartment 14 which can be filled with the coating material. A supply passage 16 of controllable cross section can deliver the coating material to the compartment 14 and that coating material overflows outwardly over the blade 15 to prevent the penetration of air and contaminants into the applicator chamber 14.

Prior to the commencement of the coating process, by the adjustment of the support beam 11, a predetermined gap is set between the doctor bar 2 and the surface 1 to be coated. The coating material is supplied in excess and the pressurizable compartments 6.1–6.4 are supplied with compressed air so that the doctor bar 2 is pressed toward the surface 1 to be coated. The doctor bar 2 removes the excess of the coating material leaving the desired basis weight (coating weight per unit area) on the surface to be coated and hence the web. Depending upon the basis weight, the subatmospheric pressure in the compartments can range between 0.3 and 2.0 bar. This pressure is transmitted via the cushion formed by the pressure tube 8 to the bed 3 and because of the cushioning effect, no sharp change in the force applied is noticeable between neighboring pressurizable compartments. Rather there is a leveling of the pressure or force so that a pressure drop in a boundary zone between two neighboring compartments is avoided as is any undesirable jump in the pressure. Undesirable changes in the basis weight applied in these regions are precluded. The basis weight is thus made relatively uniform over the entire width or can be varied locally without sudden changes.

FIGS. 3 and 4 show embodiments where the pressure is applied from below and from the side to the tube 8 and is transmitted by the tube 8 directly to the rear of the bed 3. Because the tube 8 has a curved wall in contact with the bed, the area transmitting the force to the bed 3 can be varied. Since the internal pressure within the tube 8 is constant over the entire working width, an increase in the pressing surface area results in an increase in the pressing force against the bed 3 in those regions contacted by the tube 8 over a greater area.

In the embodiment of FIG. 3, the tube 8 is received in its own bed 17 of elastomeric material and the latter is shiftable in the holder 5. The bladder 6, subdivided into compartments, here bears on the bed 17 and thus urges it and the pressure tube 8 against the rear side of the bed 3.

In the embodiment of FIG. 4, the pressurizable tube 8 fills the region between the back side of the bed 3 and the rear wall of the holder 5. The bladder 6 here presses against the tube 8 from the side and an increase in the pressure applied by the bladder 6 results in an increase in the pressing area of the tube 8 against the bed 6 and thus in an increased pressing force of the bar 2 toward the surface 1 to be coated. The elimination of pressure jumps between compartments of the bladder 6 applies in the embodiments of FIGS. 3 and 4 as well.

We claim:

1. A metering system for applying a coating to a web, comprising:

a doctor bar adapted to doctor a coating of a flowable material onto a surface and extending transversely to a path of a web to be coated and across a width thereof, said surface being one of a transfer roll from which the coating is applied onto said web or said web itself;

an elastic bed receiving said doctor bar and urging said doctor bar toward said surface;

a holder receiving said bed;

a pressurizable bladder braced against said bed upon pressurization with a fluid and subdivided across the width of said web and along the length of said bar into a plurality of individually pressurizable compartments, each separately supplied with compressed air; and an elastic element with a variable modulus of elasticity, said elastic element extending along said bar and between said bladder and a side of said bed opposite that at which said bar is provided and forming a cushion balancing force applied by said bladder along said bed, thereby preventing jumps in force applied to said bar between said compartments.

2. A metering system for applying a coating to a web, comprising:

a doctor bar adapted to doctor a coating of a flowable material onto a surface and extending transversely to a path of a web to be coated and across a width thereof, said surface being one of a transfer roll from which the coating is applied onto said web or said web itself;

an elastic bed receiving said doctor bar and urging said doctor bar toward said surface;

a holder receiving said bed;

a pressurizable bladder braced against said bed upon pressurization with a fluid and subdivided across the width of said web and along the length of said bar into a plurality of individually pressurizable compartments, each separately supplied with compressed air; and an elastic element with a variable modulus of elasticity, said elastic element extending along said bar and between said bladder and a side of said bed opposite that at which said bar is provided and forming a cushion balancing force applied by said bladder along said bed, thereby preventing jumps in force applied to said bar between said compartments, said elastic element being a continuous pressurizable tube extending over said width.

3. The metering system defined in claim 2 wherein said tube is formed in one piece with said bed.

4. The metering system defined in claim 2 wherein said bladder, said bed and said tube are received in said holder, further comprising means for shifting said holder transversely to said surface.

5. The metering system defined in claim 2 wherein said bladder and said compartments are located along a rear wall of said holder and upon pressurization are braced between said bed and said holder.

6. The metering system defined in claim 2 wherein said tube is connected via a central rib with said bed.

7. The metering system defined in claim 2 wherein said tube lies against said side of said bed opposite that at which said bar is provided with a pressure-variable pressing surface.

8. The metering system defined in claim 2 wherein each of said compartments has a compressed air tube extending out of said holder.

9. The metering system defined in claim 2 wherein a wall thickness of said tube is greater than a wall thickness of said bladder.

10. The metering system defined in claim 9 wherein said doctor bar is of circular cross section and is received in a groove of said bed opening toward said surface.

11. The metering system defined in claim 10 wherein said bed is composed of an elastomeric material.

12. The metering system defined in claim 11 wherein said web is guided along a surface of a drum and said doctor bar is pressed against said web.

* * * * *